US011841205B2

(12) United States Patent
Smith

(10) Patent No.: US 11,841,205 B2
(45) Date of Patent: Dec. 12, 2023

(54) METHODS AND APPARATUS FOR GAS PISTON

(71) Applicant: Smith Enterprise, Inc., Tempe, AZ (US)

(72) Inventor: Ronald Smith, Tempe, AZ (US)

(73) Assignee: Smith Enterprise, Inc., Tempe, AZ (US)

( * ) Notice: Subject to any disclaimer, the term of this patent is extended or adjusted under 35 U.S.C. 154(b) by 0 days.

(21) Appl. No.: 18/163,595

(22) Filed: Feb. 2, 2023

(65) Prior Publication Data

US 2023/0366644 A1 Nov. 16, 2023

Related U.S. Application Data

(60) Provisional application No. 63/306,183, filed on Feb. 3, 2022.

(51) Int. Cl.
*F41A 5/26* (2006.01)

(52) U.S. Cl.
CPC ..... *F41A 5/26* (2013.01)

(58) Field of Classification Search
CPC ..... F41A 5/18; F41A 5/20; F41A 5/22; F41A 5/24; F41A 5/26; F41A 5/28; F41A 5/30
See application file for complete search history.

(56) References Cited

U.S. PATENT DOCUMENTS 1,387,889 A * 8/1921 Johnston ..... F41A 5/26 89/193
3,680,434 A * 8/1972 Muhlemann ..... F41A 5/28 89/193
2010/0251885 A1* 10/2010 Stone ..... F41A 5/26 89/193

* cited by examiner

*Primary Examiner* — Jonathan C Weber
(74) *Attorney, Agent, or Firm* — Noblitt & Newson, PLLC

(57) ABSTRACT

A gas piston according to various aspects of the present technology comprises a helical groove disposed along an exterior surface. The helical groove may comprise curved edges at transitions between a crest and root of the helical groove. The helical groove allows for easier movement of the gas piston within its operating cylinder, provides enhanced resistance to particulate build up, and improves firing accuracy.

19 Claims, 4 Drawing Sheets

METHODS AND APPARATUS FOR GAS PISTON

CROSS-REFERENCES TO RELATED APPLICATIONS

This application claims the benefit of U.S. Provisional Patent Application No. 63/306,183, filed on Feb. 3, 2022, and incorporates the disclosure of this application by reference.

BACKGROUND OF THE TECHNOLOGY

A gas piston is used in firearms to drive an operating rod after a round is fired to first eject a spent casing and reload the next round into the chamber. The gas piston is responsive to expanding propellant gases of the fired round. The gas piston is subject to exposure to not only the propellant gases but also other particulates contained in the gas such as carbon deposits from gunpowder and extreme heat resulting from combustion. Gas piston driven firearms are reliable and proven and seldom are subject to redesigns or major improvements. For example, the gas piston design of the M14 has remained unchanged for over 50 years.

SUMMARY OF THE TECHNOLOGY

A gas piston according to various aspects of the present technology comprises a helical groove disposed along an exterior surface. The helical groove may comprise curved edges at transitions between a crest and root of the helical groove. The helical groove allows for easier movement of the gas piston within its operating cylinder, provides enhanced resistance to particulate build up, and improves firing accuracy.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, finishes, dimensions, and geometries, which may carry out a variety of operations suited to a specified application or environment. In addition, the present technology may be practiced in conjunction with any number of systems configured for operation with firearms, and the system described is merely one exemplary application for the technology. Further, the present technology may employ any number of conventional techniques for machining, metalworking, and gunsmithing.

Methods and apparatus for a gas piston for a firearm according to various aspects of the present technology may operate in conjunction with any type of rifle or mechanisms used in firearms. Various representative implementations of the present technology may be applied to retrofitting an existing automatic or semi-automatic rifle, modifying a new firearm, or manufacturing a new firearm. For example, the described technology may be used to replace or modify an original factory installed gas piston mechanism in a M14 rifle to provide improved operation.

Figure 1:
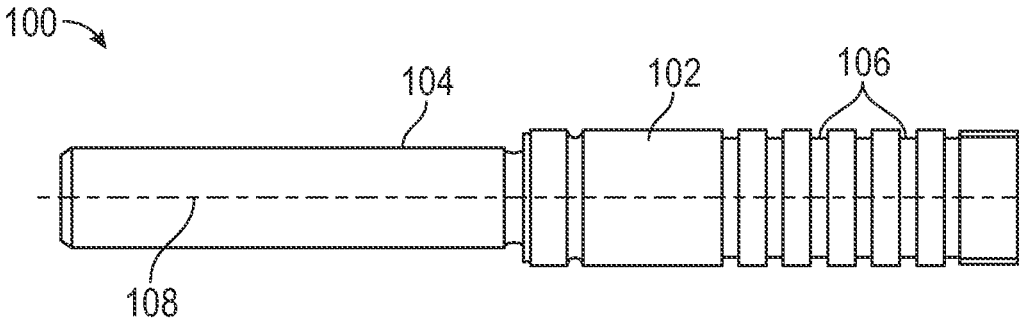
FIG. 1 (Prior Art)
FIG. 1 representatively illustrates a side view of a prior art gas piston.
Figure 2:
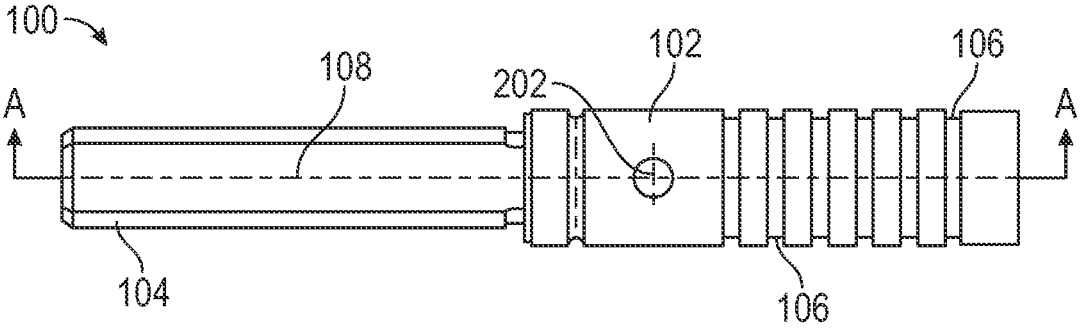
FIG. 2 (Prior Art)
FIG. 2 representatively illustrates a top view of the gas piston shown in FIG. 1.
Figure 3:
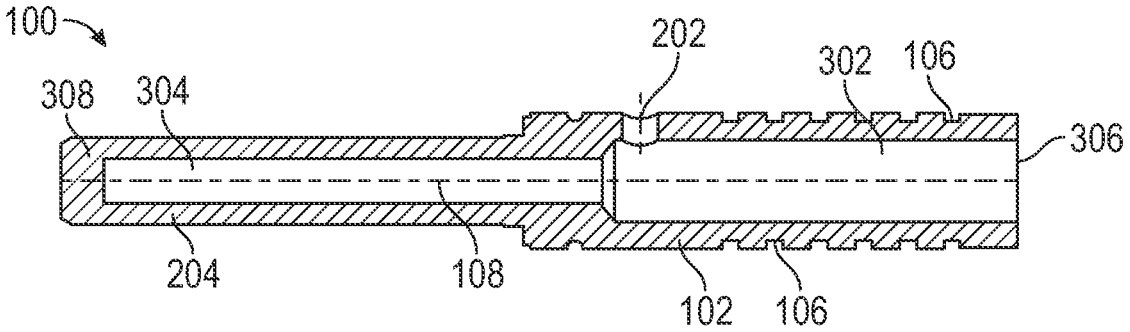
FIG. 3 (Prior Art)
FIG. 3 representatively illustrates a cross-sectional view of the prior art gas piston shown in FIG. 2 across line A-A.
Figure 4:
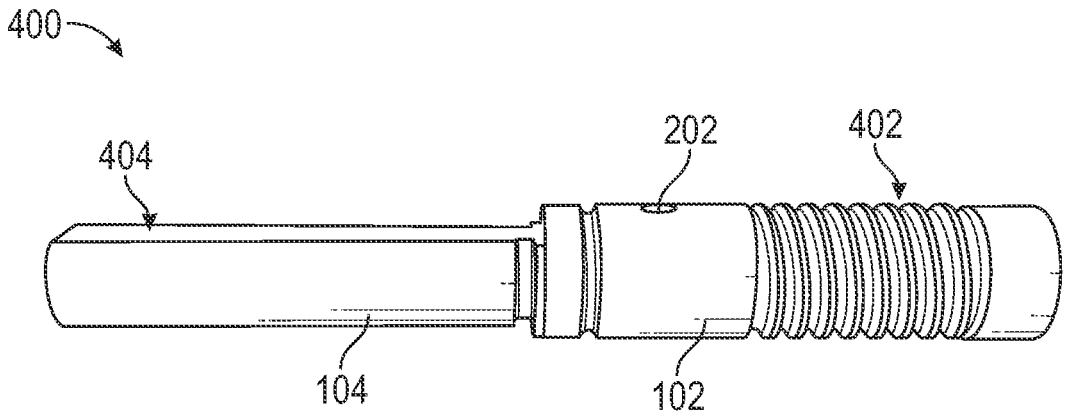
FIG. 4 representatively illustrates a side view of a gas piston having a helical groove in accordance with an exemplary embodiment of the present technology.
Figure 5:
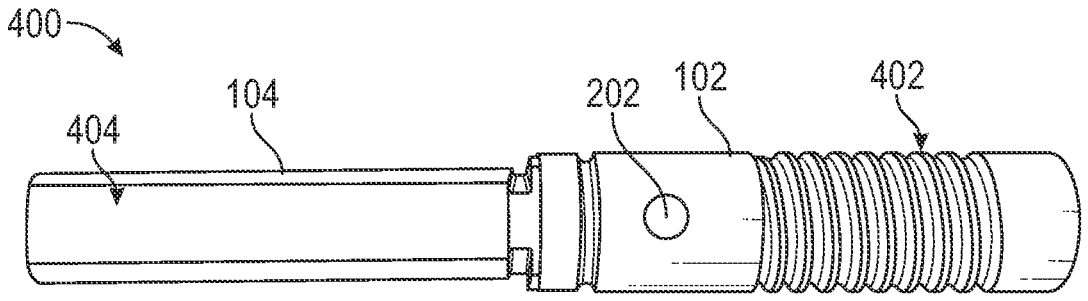
FIG. 5 representatively illustrates a top view of the gas piston shown in FIG. 4 in accordance with an exemplary embodiment of the present technology.
Figure 6:
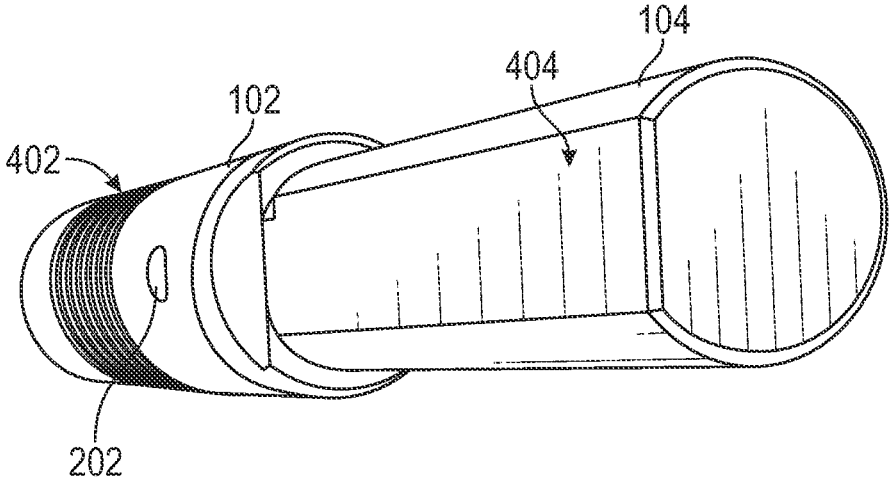
FIG. 6 representatively illustrates an end perspective view of the gas piston in accordance with an exemplary embodiment of the present technology.
Figure 7:
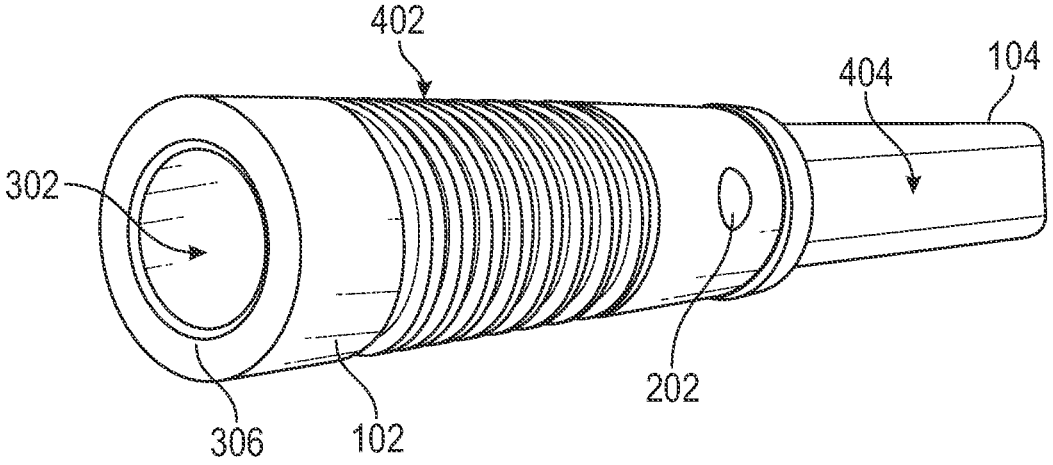
FIG. 7 representatively illustrates an opposing end perspective view of the gas piston to that shown in FIG. 6 in accordance with an exemplary embodiment of the present technology.

Referring now to FIGS. 1-3, a prior art gas piston 100 comprises a dual chambered piston body having a first section 102 and a second section 104. The first section 102 may comprise a larger outer diameter than that of the second section 104. The second section 104 may also be configured with a flat surface 404 (see FIG. 4) that acts as an alignment mechanism to properly insert the gas piston 100 into an operating cylinder. The first section 102 comprises a series of individual grooves 106 disposed parallel to each other along a length of an exterior surface of the first section 102. The grooves 106 are perpendicular to a longitudinal axis 108 of the gas piston 100. The first section 102 further comprises a gas port 202 positioned near a mid-portion of the dual chambered body and is configured to provide a conduit to an open interior portion of the gas piston 100 where a first chamber 302 and a second chamber 304 are located. The gas port 202 is configured to align with a port in the barrel of the firearm (not shown) prior to the discharge of a round. This alignment allows for a portion of propellant gases created upon firing of the round to pass from the barrel through the gas port 202 and into the first and second chambers 302, 304.

The first chamber 302 is positioned within the first section 102 and comprises an opening located at a first end portion 306 of the gas piston 100 such that propellant gases may flow freely out of the first end portion 306. The second chamber 304 is positioned within the second section 104 of the gas piston 100 and may extend slightly into the first section 102. The second chamber 304 has a smaller diameter than that of the first chamber 302. The first and second chambers 302, 304 are interconnected with each other at or near the mid-portion of the dual chambered body proximate the gas port 202 such that propellant gas is able flow into both chambers 302, 304 after passing through the gas port 202. The second chamber 304 is sealed at or near a second end portion 308 of the gas piston 100 such that propellant gas acts on the second end portion 308 to move the gas piston 100 within its operating cylinder (not shown) of the firearm.

The series of individual grooves 106 form parallel channels between the first end portion 306 and the gas port 202.

The series of individual grooves 106 allow gas exiting out of the opening in the first end portion 306 to pass over the exterior of the gas piston 100 and out of an exhaust port of the firearm during operation.

With reference now to FIGS. 4-8, a modified gas piston 400 comprises a helical groove 402 disposed along an exterior surface of the first section 102 of the piston body. The helical groove 402 may comprise a single continuous channel progressing along a length of the exterior surface of the first section 102 similar to threads on a fastener such as a bolt or a screw. The helical groove 402 may progress along the length of the first section 102 in a clockwise or counterclockwise manner. The helical groove 402 may comprise any suitable length along the surface of the first section 102. For example, in one embodiment, a length of the helical groove 402 from end to end may comprise a distance of between about 18 mm (0.71") and about 24 mm (0.94").

Figure 8:
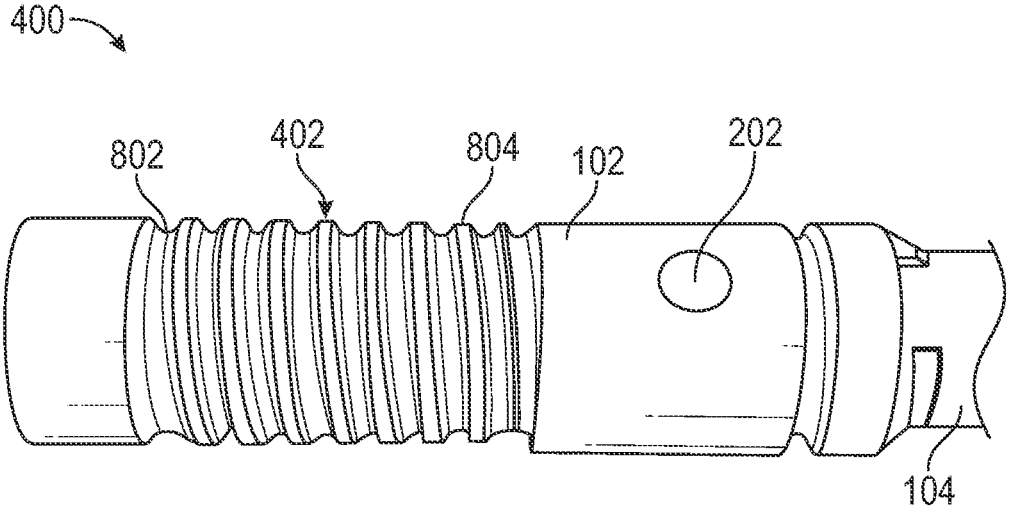
FIG. 8 representatively illustrates a detailed view of the helical groove in accordance with an exemplary embodiment of the present technology.

With particular reference now to FIG. 8, when viewed from the side of the gas piston 400, the helical groove 402 may form a series of roots 802 and crests 804. The roots 802 and crests 804 may comprise any shape or size capable of allowing the gas piston 400 to slide within a gas cylinder (not shown) of the firearm during operation while providing for a desired flow of gas and particulate matter over and around the roots 802 and crests 804. In one embodiment, the crests 804 may comprise a substantially flat surface having a width of between about 0.5 mm (0.02") and about 1.5 mm (0.06") and a height, as measured from a longitudinal axis of the gas piston 400, that is equal to that of the exterior surface of the first section at the first end portion 306 and a portion of the first section 102 proximate the gas port 202. In an alternative embodiment, the crests 804 may comprise a curved or pointed surface having a height, or radius, that is equal to that of the exterior surface of the first section at the first end portion 306 and the portion of the first section 102 proximate the gas port 202. In another embodiment, an outermost surface of the crests 804 may have a height that is below the exterior surface of the first section at the first end portion 306 and the portion of the first section 102 proximate the gas port 202 to reduce an amount of surface contact between the gas piston 400 and its operating cylinder on the firearm.

The roots 802 may comprise any suitable size or shape. The roots 802 may have a width (distance between adjacent crests 804) of any suitable amount and may be less than, equal to, or greater than the width of an individual crest 804. For example, in one embodiment, the roots 802 may comprise a squared channel having a width that is equal to the width of the crests 804. In another embodiment, the roots 802 may comprise a radiused cut having a smoothly curved surface that extends between adjacent crests 804. A depth of each root 802 may be approximately equal to the width between crests 802. For example, in one embodiment, the roots 802 may comprise a width of between about 1.0 mm (0.04") and about 2.5 mm (0.10") and the lowermost surface of each root 802 may have a depth equal to the width. In yet another embodiment, the width of each root 802 may be between about 1.2 and about 2.5 times greater than the width of the crest 804.

The helical groove 402 may progress along the length of the first section 102 by any suitable or desired degree. For example, in one embodiment, the helical groove may comprise a pitch of between about 2.39 mm (0.94") and about 2.67 mm (0.105"). In another embodiment, the pitch of the helical groove 402 may be determined according to a desired number of roots 802 and crests 804 for a given length of the helical groove 402 along the first section 102. For example, if the helical groove 402 comprises a length of about 23 mm and the desired number of roots 802 and crests 804 is 9, then the pitch of the helical groove 402 may be set accordingly to meet that requirement. Increasing or decreasing the pitch results in a greater or lesser number of roots 802 and crests 804 which may be used to increase or decrease the ease at which the gas piston 400 is able to slide within the operating cylinder during use.

A curved root 802 may allow the helical groove 402 to be cleaned of debris easier than a root 802 having sharply angled corners. The curving nature of the roots 802 may also allow carbon build up during use to provide a smoother sliding action within the piston cylinder (not shown) after a round is fired compared to the prior art gas piston 100.

An unexpected result of the combination of the helical groove 402 and a curved root 802 is improved accuracy of the firearm during use. For example, when the disclosed gas piston 400 having a crest 804 with a width of about 1 mm (0.04") and a root with a width of about 1.5 mm (0.06") is used in a M14 rifle, accuracy of the firearm was improved by up to 56% compared to the standard prior art gas piston 100.

The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the technology has been described with reference to specific exemplary embodiments. Various modifications and changes may be made, however, without departing from the scope of the present technology as set forth in the claims. The specification and figures are illustrative, rather than restrictive, and modifications are intended to be included within the scope of the present technology. Accordingly, the scope of the technology should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims. Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise," "comprises," "comprising," "having," "including," "includes," or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same. Any terms of degree such as "substantially," "about," and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

The invention claimed is:

1. A gas piston for a firearm, comprising:
a dual chambered piston body, comprising:
a first section having a first outer diameter;
a second section having a second outer diameter, wherein the second diameter is less than the first diameter;
an open first end;
a closed second end; and
a gas port located on the first section;
a first chamber disposed within the first section of the dual chambered piston body;
a second chamber disposed within the second section, wherein the first chamber comprises a greater diameter than the second chamber; and
a helical groove disposed along an exterior surface of the first section and extending between the open first end and the gas port.

2. A gas piston for a firearm according to claim 1, wherein the gas port is in fluid communication with the first chamber.

3. A gas piston for a firearm according to claim 1, wherein the second chamber extends into a portion of the first chamber.

4. A gas piston for a firearm according to claim 1, wherein:
a crest of the helical groove comprises a first width; and
a root of the helical groove comprises a second width.

5. A gas piston for a firearm according to claim 4, wherein the first width is less than the second width.

6. A gas piston for a firearm according to claim 4, wherein the first width is greater than the second width.

7. A gas piston for a firearm according to claim 4, wherein the first width is equal to the second width.

8. A gas piston for a firearm according to claim 4, wherein the root comprises a radiused cut having a smoothly curved surface that extends between adjacent crests.

9. A gas piston for a firearm according to claim 4, wherein a height of the crest is below the exterior surface of the first section relative to a longitudinal axis of the dual chambered piston body.

10. A gas piston for a firearm according to claim 1, wherein the helical groove comprises pitch of between about 2.39 mm (0.94") and about 2.67 mm (0.105").

11. A gas piston for a firearm, comprising:
a piston body having an open interior section extending between an open first end and a closed second end;
a gas port extending between an exterior surface of the piston body and the open interior section; and
a helical groove disposed along the exterior surface and extending between the open first end and the gas port.

12. A gas piston for a firearm according to claim 11, wherein:
a crest of the helical groove comprises a first width; and
a root of the helical groove comprises a second width.

13. A gas piston for a firearm according to claim 12, wherein the first width is less than the second width.

14. A gas piston for a firearm according to claim 12, wherein the first width is greater than the second width.

15. A gas piston for a firearm according to claim 12, wherein the first width is equal to the second width.

16. A gas piston for a firearm according to claim 12, wherein the root comprises a radiused cut having a smoothly curved surface that extends between adjacent crests.

17. A gas piston for a firearm according to claim 12, wherein a height of the crest is below the exterior surface of the first section relative to a longitudinal axis of the dual chambered piston body.

18. A gas piston for a firearm according to claim 11, wherein the helical groove comprises pitch of between about 2.39 mm (0.94") and about 2.67 mm (0.105").

19. A gas piston for a firearm according to claim 11, wherein:
the piston body further comprises:
a first section having a first outer diameter;
a second section having a second outer diameter, wherein the second diameter is less than the first diameter;
a first chamber disposed within the first section of the dual chambered piston body and forming a first portion of the open interior section; and
a second chamber disposed within the second section and forming a second portion of the open interior section, wherein the first chamber comprises a greater diameter than the second chamber; and
the gas port is in fluid communication with the first chamber.

* * * * *